United States Patent [19]

Castillo

[11] Patent Number: 4,546,913

[45] Date of Patent: Oct. 15, 1985

[54] REINFORCED CORNER INTERLOCK ON TRAY

[76] Inventor: Carmen S. Castillo, Miramar, 22, Gandia (Valencia), Spain

[21] Appl. No.: 553,396

[22] Filed: Nov. 18, 1983

[30] Foreign Application Priority Data

Jul. 8, 1983 [ES] Spain ..... 273.423[U]

[51] Int. Cl.[4] ..... B65D 5/22

[52] U.S. Cl. ..... 229/33; 229/32; 229/35

[58] Field of Search ..... 229/31 R, 31 FS, 32, 229/33, 34 R, 34 A, 34 B, 34 HW, 35, 36

[56] References Cited

U.S. PATENT DOCUMENTS

| | | | |
|---|---|---|---|
| 2,654,526 | 10/1953 | McReary | 229/31 R X |
| 3,375,967 | 4/1968 | Robinson | 229/34 R |
| 3,871,570 | 3/1975 | Garmon | 229/32 X |
| 4,385,721 | 5/1983 | Olsen et al. | 229/32 |
| 4,418,863 | 12/1983 | Kimbell, Sr. | 229/32 X |

FOREIGN PATENT DOCUMENTS

| | | | |
|---|---|---|---|
| 2034825 | 1/1972 | Fed. Rep. of Germany | 229/34 R |
| 1571502 | 6/1969 | France | 229/34 HW |
| 2423404 | 12/1979 | France | 229/33 |

*Primary Examiner*—William Price
*Assistant Examiner*—Gary E. Elkins
*Attorney, Agent, or Firm*—Wenderoth, Lind & Ponack

[57] ABSTRACT

A collapsible box is formed of a single cardboard sheet and includes a rectangular bottom panel, side panels extending from opposite sides of the bottom panel, and end panels extending from opposite ends of the bottom panel. Each end panel has corner flaps, each of which includes a plurality of panels bent with respect to each other to form a triangular reinforcement of a corner formed by respective side and end panels. Each end panel has extending therefrom a top panel which extends horizontally over tops of respective reinforcements. End flaps extend from ends of each top panel and extend downwardly therefrom. Each side panel has formed therein upwardly facing cut-outs, and each end flap has extending downwardly therefrom an extension which fits into a respective cut-out. Each top panel has formed therein slits, and each corner flap has extending from one of the panels thereof a tongue which fits into a respective slit.

4 Claims, 2 Drawing Figures

REINFORCED CORNER INTERLOCK ON TRAY

BACKGROUND OF THE INVENTION

The present invention relates to a collapsible box formed of a single cardboard sheet including integral elements enabling direct connection between end and side panels of the box, such elements being formed during a stamping operation by which the cardboard sheet is formed.

In the container industry, and more specifically in that portion of such industry relating to the production of cardboard boxes for packing perishable products such as fruit and vegetables, the containers must be sufficiently strong and nondeformable to permit transportation thereof without damage to the contents.

During the final assembly operation of known collapsible boxes, connections are formed between side and end panels of the box. Such operation however requires special tools and equipment and therefore increases manufacturing costs.

SUMMARY OF THE INVENTION

Accordingly, it is the object of the present invention to provide an improved collapsible box formed of a single cardboard sheet whereby it is possible to overcome the above prior art disadvantages and whereby connections between side and end panels of the box are simplified.

This object is achieved in accordance with the present invention by the provision of a collapsible box formed of a single cardboard sheet, the box including a rectangular bottom panel, side panels extending from opposite sides of the bottom panel and bent to extend vertically therefrom along respective parallel first fold lines, and end panels extending from opposite ends of the bottom panel and bent to extend vertically therefrom along respective parallel second fold lines extending transverse to the first fold lines. Corner flaps extend from ends of each end panel and are bent with respect thereto along respective vertical third fold lines. Each corner flap includes plural panels bent with respect to each other along respective vertical fourth fold lines extending parallel to the respective third fold line, thus forming a triangular reinforcement of a corner formed by the juncture of ends of respective side and end panels. Each end panel has extending therefrom a top panel bent with respect thereto to extend horizontally therefrom over tops of respective reinforcements along respective fifth fold lines extending parallel to the second fold lines. End flaps extend from ends of each top panel and are bent with respect thereto to extend downwardly therefrom along respective sixth fold lines extending transverse to the fifth fold lines. Each side panel has in end portions thereof upwardly facing cut-outs, and each end flap has extending downwardly therefrom an extension of a shape complementary to and fitting within a respective cut-out. Each corner flap has formed in the panel thereof adjacent the respective end panel a first slit, such that each extension partially fits into a respective first slit with pressure. Each top panel has formed in end portions thereof second slits, and each corner flap has extending from one of the panels thereof a tongue, each tongue fitting within a respective second slit.

BRIEF DESCRIPTION OF THE DRAWINGS

Other objects, features and advantages of the invention will be apparent from the following description, taken with the accompanying drawings, wherein.

DETAILED DESCRIPTION OF THE INVENTION

The drawings illustrate elements at one corner of a box illustrating the novel features of the present invention. It is to be understood however that similar elements are provided to form the other three corners of the box.

Figure 2:
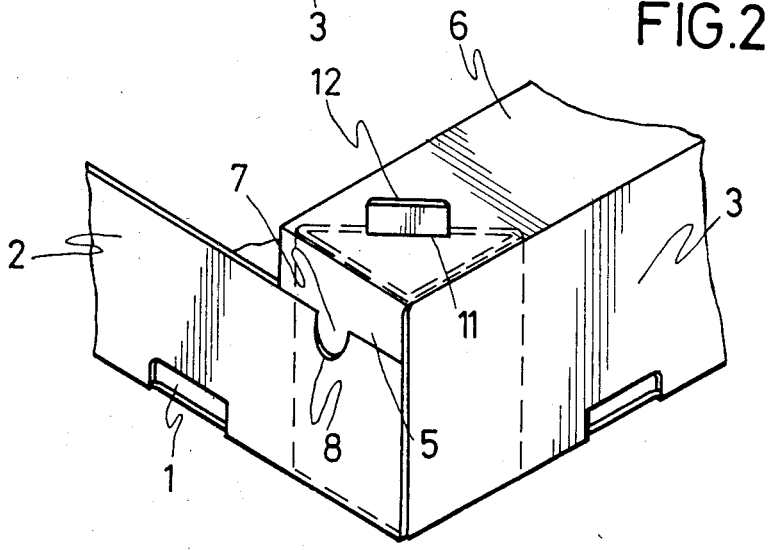
FIG. 2 is a partial perspective view of one corner of the box of the present invention assembled from the portion of the sheet shown in FIG. 1.

The box of the present invention is formed of a single cardboard sheet and includes a rectangular bottom panel 1, side panels 2 extending from opposite sides of bottom panel 1 and bent to extend vertically therefrom along respective parallel first fold lines 2*a*, and end panels 3 extending from opposite ends of bottom panel 1 and bent to extend vertically therefrom along respective parallel second fold lines 3*a* extending transverse to first fold lines 2*a*. Corner flaps 4 extend from ends of each end panel 3 and are bent with respect thereto along respective vertical third fold lines 4*a*. Each corner flap 4 includes plural panels 4' bent with respect to each other along respective vertical fourth fold lines 4'*a* extending parallel to the respective third fold line 4*a*, thus forming a triangular reinforcement of the corner formed by respective side panels 2 and end panels 3. This triangular reinforcement is shown particularly by the dashed lines in FIG. 2.

Each end panel 3 has extending therefrom a top panel 6 bent with respect thereto to extend horizontally therefrom over tops of respective of the reinforcements along respective fifth fold lines 6*a* extending parallel to second fold lines 3*a*. End flaps 5 extend from ends of each top panel 6 and are bent with respect thereto to extend downwardly therefrom (as shown particularly in FIG. 2) along respective sixth fold lines 5*a* extending transverse to fifth fold lines 6*a*.

In accordance with the present invention, there is provided structure integral with the single sheet of cardboard material to achieve satisfactory connection of the various elements, particularly the side and end panels, to achieve a sturdy box.

Thus, each side panel 2 has in end portions thereof upwardly facing cut-outs 8, preferably of a generally circular configuration. Similarly, each end flap 5 has extending downwardly therefrom an extension 7 of a shape complementary to and fitting within a respective cut-out 8. Furthermore, each corner flap 4 has formed in the panel 4' thereof which is adjacent the respective end panel 3 a first slit 10, and each extension may partially fit into respective first slit 10 by pressure. In the illustrated arrangement, slit 10 is generally X-shaped, but similarly could be T-shaped.

Figure 1:
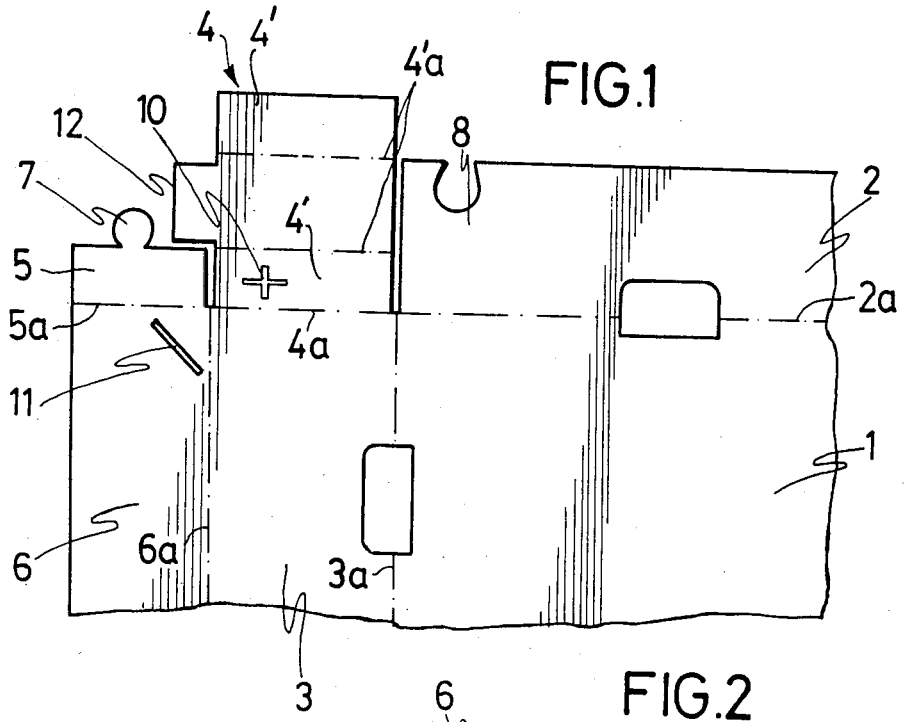
FIG. 1 is a partial plan view of an unfolded and stamped cardboard sheet from which the box of the present invention is formed.

Furthermore, each top panel 6 has formed in end portions thereof second slits 11, and each corner flap 4 has extending from one of the panels 4' thereof a tongue 12 which fits into a respective second slit 11. In the illustrated arrangement, the middle panel 4' includes the tongue 12, and accordingly the slit 11 extends obliquely to fifth and sixth fold lines *6a, 5a,* as particularly shown in FIG. 1.

Although the present invention has been described and illustrated with respect to a preferred embodiment thereof, various changes and modifications may be made to the specifically described and illustrated arrangements without departing from the scope of the present invention.

I claim:

1. A collapsible box formed of a single cardboard sheet, said box comprising:

a rectangular bottom panel;

side panels extending from opposite sides of said bottom panel and bent to extend vertically therefrom along respective parallel first fold lines;

end panels extending from opposite ends of said bottom panel and bent to extend vertically therefrom along respective parallel second fold lines extending transverse to said first fold lines;

corner flaps extending from ends of each said end panel and bent with respect thereto along respective vertical third fold lines;

each said corner flap comprising plural panels bent with respect to each other along respective vertical fourth fold lines extending parallel to the respective third fold line, thus forming a triangular reinforcement of a corner formed by respective said side and end panels, one of said panels of each said corner flap being disposed adjacent the respective said end panel;

each said end panel having extending therefrom a top panel bent with respect thereto to extend horizontally therefrom over tops of respective said reinforcements along respective fifth fold lines extending parallel to said second fold lines;

end flaps extending from ends of each said top panel and bent with respect thereto to extend downwardly therefrom along respective sixth fold lines extending transverse to said fifth fold lines;

each said side panel having in end portions thereof upwardly facing cut-outs;

each said end flap having extending downwardly therefrom an extension of a shape complementary to and fitting within a respective said cut-out;

each said corner flap having formed in said one panel a first slit, each said extension partially fitting into a respective said first slit;

each said top panel having formed in end portions thereof second slits; and each said corner flap having extending from one of said panels thereof a tongue, each said tongue fitting into a respective said second slit.

2. A box as claimed in claim 1, wherein each said first slit is X-shaped.

3. A box as claimed in claim 1, wherein each said second slit extends obliquely with respect to said fifth and sixth fold lines.

4. A box as claimed in claim 1, wherein each said cut-out and extension is of a generally circular configuration.

* * * * *